US011410601B2

(12) United States Patent
Fu

(10) Patent No.: US 11,410,601 B2
(45) Date of Patent: Aug. 9, 2022

(54) VOLTAGE ADJUSTING METHOD FOR A DISPLAY PANEL AND RELATED COMPUTER READABLE MEDIUM

(71) Applicant: Shenzhen China Star Optoelectronics Semiconductor Display Technology Co., Ltd., Shenzhen (CN)

(72) Inventor: Jianhang Fu, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 194 days.

(21) Appl. No.: 16/621,251

(22) PCT Filed: Nov. 18, 2019

(86) PCT No.: PCT/CN2019/119256

§ 371 (c)(1),
(2) Date: Dec. 11, 2019

(87) PCT Pub. No.: WO2021/088120

PCT Pub. Date: May 14, 2021

(65) Prior Publication Data

US 2021/0335259 A1 Oct. 28, 2021

(30) Foreign Application Priority Data

Nov. 4, 2019 (CN) ..... 201911064319.X

(51) Int. Cl.
*G09G 3/3233* (2016.01)

(52) U.S. Cl.
CPC ... *G09G 3/3233* (2013.01); *G09G 2320/0214* (2013.01); *G09G 2320/0233* (2013.01);
(Continued)

(58) Field of Classification Search
CPC .. G09G 3/3233; G09G 3/3258; G09G 3/3283; G09G 3/3291; G09G 2300/0819; G09G 2310/0294; G09G 2320/0233; G09G 2320/043; G09G 2320/045; G09G 2320/0214; G09G 2320/0693
(Continued)

(56) References Cited

U.S. PATENT DOCUMENTS 9,460,661 B2 * 10/2016 Shim ..... G09G 3/3233
2016/0148578 A1 * 5/2016 Kishi ..... G09G 3/3291 345/212

(Continued)

*Primary Examiner* — Tom V Sheng

(57) ABSTRACT

The present disclosure provides method and a computer readable medium for adjusting voltage applied on a display panel. The present disclosure could utilize the ratio of Vgs of two different tests, as an adjustment factor, to compensate the voltage value of each display area. Thus, the method could obtain the same compensation voltage for different display area to compensate the voltage difference between the node G and the node S. This could reduce the influence of the output step. In addition, the method could further detect the inputted compensation voltage to obtain a current value according to a second adjusting step. Through the current formula, the ratio of constant k of each display area could be obtained to adjust the threshold value of the TFT according to the current formula such that the current of each display area could be consistent.

16 Claims, 3 Drawing Sheets

(52) U.S. Cl.
CPC ..... *G09G 2320/045* (2013.01); *G09G 2320/0693* (2013.01)

(58) Field of Classification Search
USPC ..... 345/76
See application file for complete search history.

(56) References Cited

U.S. PATENT DOCUMENTS

| | | | | |
|---|---|---|---|---|
| 2016/0180815 | A1* | 6/2016 | Pyo | G09G 3/2022 345/213 |
| 2017/0124947 | A1* | 5/2017 | Kim | G09G 3/3233 |
| 2019/0103060 | A1* | 4/2019 | Kang | H01L 51/5206 |
| 2019/0164492 | A1* | 5/2019 | Oh | G09G 3/3258 |
| 2020/0043414 | A1* | 2/2020 | Wang | G09G 3/3233 |

* cited by examiner

VOLTAGE ADJUSTING METHOD FOR A DISPLAY PANEL AND RELATED COMPUTER READABLE MEDIUM

RELATED APPLICATIONS

This application is a National Phase of PCT Patent Application No. PCT/CN2019/119256 having International filing date of Nov. 18, 2019, which claims the benefit of priority of Chinese Patent Application No. 201911064319.X filed on Nov. 4, 2019. The contents of the above applications are all incorporated by reference as if fully set forth herein in their entirety.

FIELD AND BACKGROUND OF THE INVENTION

The present invention relates to a display technique, and more particularly, to a voltage adjusting method for a display panel and a related computer readable medium.

As shown in FIG. 1, a conventional organic light-emitting diode (OLED) driving circuit has a 3T1C structure, which could not only drive the OLED to emit light, but also detect the device characteristic through sensing the thin film transistor (TFT).

As a current driven device, the luminance of the OLED is determined by the current flowing through the driving TFT. The driving TFT works at the saturation region when the OLED is emitting lights and the corresponding current formula is:

$$I_{ds} = \frac{1}{2} C_i \mu \frac{W}{L} (V_{gs} - V_{th})^2$$

Here, Ci represents the insulator capacitance per unit area. μ represents the mobility. W represents the channel width of the TFT. L represents the channel length of the TFT. Vgs represents the voltage difference between the node G and the node S. Vth represents the threshold value of the TFT. Therefore, the current formula could be rewritten into the formula below, where k is a constant.

$$I_{ds}=k(V_{gs}-V_{th})^2$$

Because the constant k and the threshold value Vth of each sub-pixel may have some differences, even if the same voltage signal Vdata is inputted, different areas of the OLED display panel may have different luminance.

SUMMARY OF THE INVENTION

One objective of an embodiment of the present invention is to provide a voltage adjusting method for the display panel and the related computer readable medium are required to solve the above-mentioned issue of uneven luminance of different areas of the display panel. An embodiment of the present invention could compensate the voltage value of each display area and obtain the same compensation voltage for different display areas such that each display area could have the same current.

According to an embodiment of the present invention, a voltage adjusting method for a display panel is disclosed. The voltage adjusting method comprises: a database establishing step, loading display data of a display panel, wherein the display data includes a voltage value and an adjustment factor of each display area and the voltage value of each display area is consistent; a first collecting step, collecting the voltage value and the adjustment factor of each display area; a first calculating step, predetermining a compensation factor for each display area and multiplying the voltage value, the adjustment factor and the compensation factor to obtain a compensation voltage; and a first adjusting step, adjusting the compensation factor for each display area to make the compensation voltage of each display area consistent.

Furthermore, the display data further comprises a threshold value of a predetermined thin film transistor (TFT) of each display area.

Furthermore, the voltage adjusting method further comprises an output step. The output operation performs outputting the compensation voltage of each display area to each display area to compensate a current value of each display area.

Furthermore, the step of compensating the current value of each display area comprises a detection step, a third calculating step, and a second adjusting step. The detection step performs detecting the current value of each display area and store the current value of each display area into a database. The third calculating step performs collecting the current value and the threshold value of the predetermined TFT of each display area, and calculating a relationship between constants k of different display areas according to a current formula, and storing the relationship into the database. The second adjusting step performs collecting the relationship and the current value of each display area, and adjusting the threshold value of the TFT of each display area according to the current formula to make the current of each display area consistent.

Furthermore, the voltage adjusting method further comprises a preparation step and a testing step. The preparation step performs providing the display panel, dividing the display panel into a plurality of display areas, and inputting the voltage value to each of the display panel. The testing step performs obtaining the adjustment factor of each display are through a penal luminance measurement method. The preparation step and the testing step are prior to the data base establishing step.

Furthermore, the display area comprises one sub-pixel or multiple sub-pixels.

Furthermore, the testing step comprises a pre-sensing step, a sampling step, and a second calculating step. The pre-sensing step performs turning on a first switch and a second switch to collect a voltage difference Vgs between a node G and a node S, where Vgs=Vdata−Vref, Vdata represents a voltage level of the node G and Vref represents a voltage level of the node S. The sampling step performs turning off a scan TFT and turning on a sensing TFT to collect a current voltage difference Vgs' between the node G and the node S. The second calculating step performs calculating a ratio of Vgs' and Vgs to obtain the adjustment factor of each display area.

Furthermore, the testing step comprises obtaining the current value of each display area through voltages converted by an analog-to-digital converter.

Furthermore, the display panel comprises an OLED display panel, a micro LED display panel or a Mini LED display panel.

According to an embodiment of the present invention, a computer readable medium is disclosed. The computer readable medium stores computer programs for a processor to execute to perform the above voltage adjusting method.

The present invention provides a voltage adjusting method for a display panel. The method could utilize the ratio of Vgs of two different tests, as an adjustment factor, to compensate the voltage value of each display area. Thus, the method could obtain the same compensation voltage for different display area to compensate the voltage difference between the node G and the node S. This could reduce the influence of the output step. In addition, the method could further detect the inputted compensation voltage to obtain a current value according to a second adjusting step. Through the current formula, the ratio of constant k of each display area could be obtained to adjust the threshold value of the TFT according to the current formula such that the current of each display area could be consistent.

BRIEF DESCRIPTION OF THE SEVERAL VIEWS OF THE DRAWINGS

The accompanying drawings described herein are used to provide further comprehension of the present disclosure, and is a part of the present application. Schematic embodiments of the present disclosure and the description thereof are used to illustrate the present disclosure, but do not constitute any improper limit to the present disclosure. In the accompanying drawings.

DETAILED DESCRIPTION OF PREFERRED SPECIFIC EMBODIMENTS OF THE INVENTION

Specifically, the terminologies in the embodiments of the present invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 2:
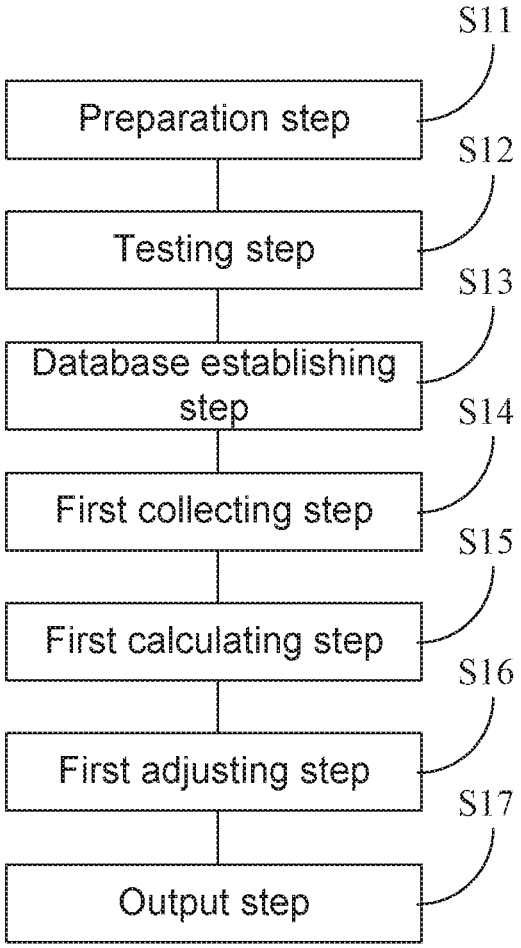
FIG. 2 is a flow chart of a voltage adjusting method for a display panel according to an embodiment of the present invention.

Please refer to FIG. 2. FIG. 2 is a flow chart of a voltage adjusting method for a display panel according to an embodiment of the present invention. The voltage adjusting method comprises following steps:

S11: Preparation step: provide a display panel, divide the display panel into a plurality of display areas, and input a voltage value to each of the display panel. The display area is composed of one sub-pixel or a plurality of sub-pixels. In the following disclosure, the symbol V is used to represent the voltage value, the Vdata signal shown in FIG. 1. The display panel comprises an OLED display panel, a micro LED display panel or a Mini LED display panel.

S12: Testing step: obtain the adjustment factor ai of each display are through a penal luminance measurement method. In the testing step, the adjustment factor ai could be obtained through pixel simulation.

Figure 1:
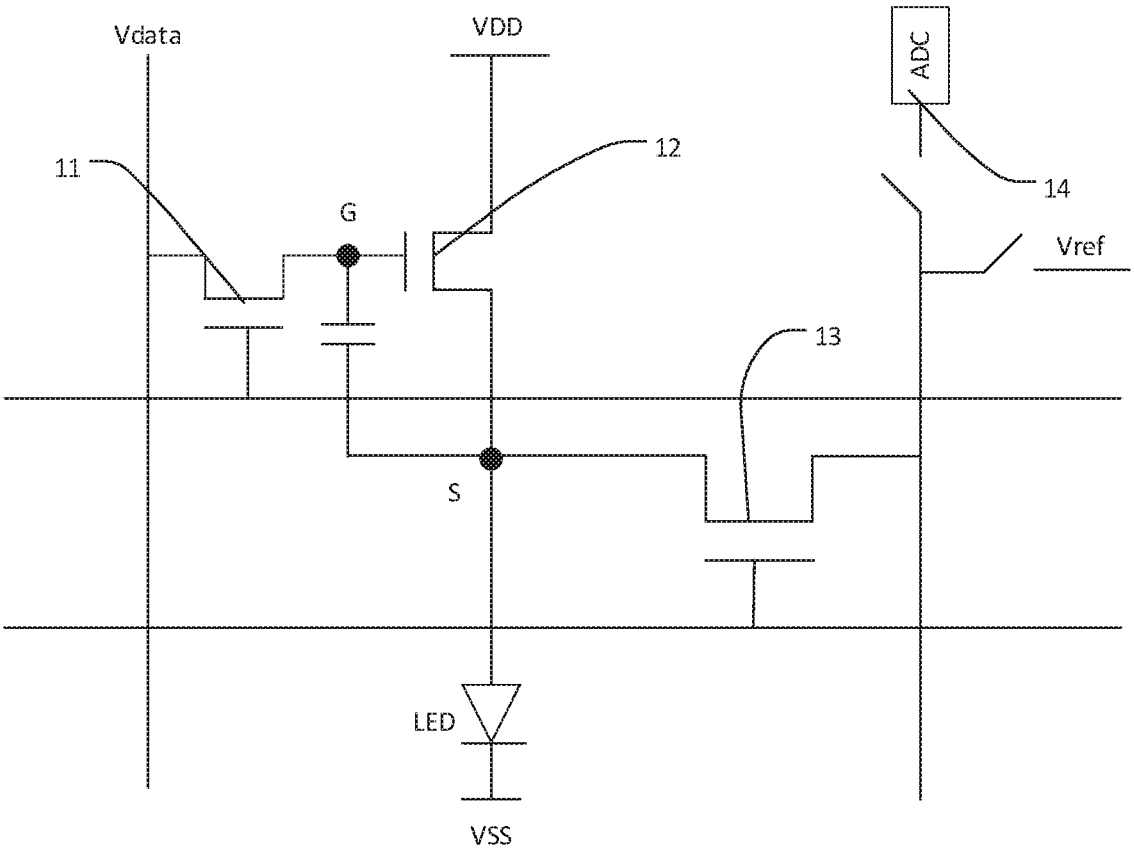
Fig. 1 (Related art)
FIG. 1 is a circuit diagram of a conventional 3T1C driving circuit.
Figure 3:
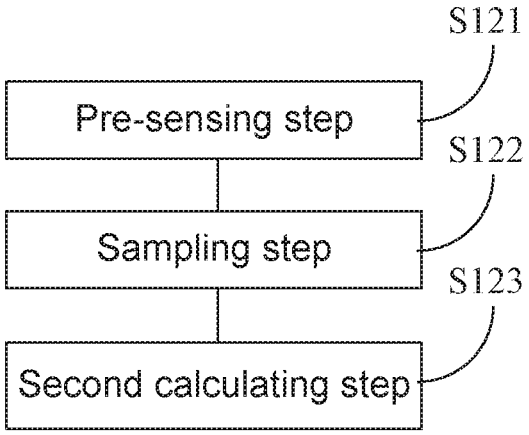
FIG. 3 is a flow chart of a testing step according to an embodiment of the present invention.
Figure 4:
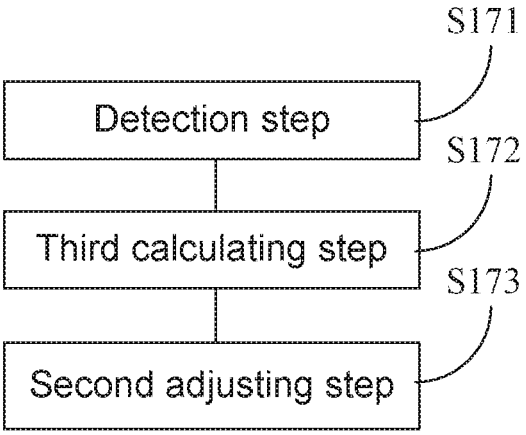
FIG. 4 is a flow chart of an output step according to an embodiment of the present invention.

Please refer to FIG. 3 in conjunction with FIG. 1. FIG. 3 is a flow chart of a testing step according to an embodiment of the present invention. As shown in FIG. 3, the testing step comprises the following steps:

S121: Pre-sensing step: Turn on the scan TFT 11 and the sensing TFT 13 to collect a voltage difference Vgs between a node G and a node S. The formula is: Vgs=Vdata-Vref, where Vdata represents a voltage level of the node G and Vref represents a voltage level of the node S.

S122: Sampling step: Turn off the scan TFT 11 and turn on the sensing TFT 13 to collect a current voltage difference Vgs' between the node G and the node S.

In a panel luminance measurement step, the voltage difference Vgs in the pre-sensing step and the voltage difference Vgs' in the sampling step may be different. The reason could be: 1. The capacitor coupling effect caused at the time when the scan TFT 11 is tuned off may reduce the voltage level of the node G. 2. The node G has leakage currents, which causes voltage drop at the node G. Here, different pixels may have different leakage currents.

In the sampling step, the voltage level of the node S changes, theoretically, the voltage level of the node G should have the same change due to capacitor coupling effect. However, because there are some other capacitors in addition to the pixel capacitor at the node G and each pixel may have different capacitor, the voltage level of the node G of each pixel may have a different variance.

S123: Second calculating step: calculate a ratio of Vgs' and Vgs to obtain the adjustment factor ai of each display area.

Because the Vgs of different sub-pixels may be different in the sampling step, the present invention utilizes the ratio of Vgs' and Vgs (which represent the Vgs in two different steps) as the adjustment factor ai and then adjusts the voltage value V according to the adjustment factor. In this way, the present invention could balance the Vgs of each display area.

The voltage adjusting method further comprises:

S13: Database establishing step: load display data of the display panel, wherein the display data includes the voltage value V and the adjustment factor ai of each display area. Here, the symbol i represents the number of each display area and the voltage value V of each display area is consistent. Further, the display data may further comprise the current value I, another adjustment factor bi of each display area, and the threshold voltage of a predetermined TFT of each display area.

S14: First collecting step: collect the voltage value V and the adjustment factor of each display area ai.

S15: First calculating step: predetermine a compensation factor gi for each display area and multiplying the voltage value V, the adjustment factor ai and the compensation factor gi to obtain a compensation voltage.

S16: First adjusting step: adjust the compensation factor gi for each display area to make the compensation voltage of each display area consistent. Here, the compensation voltage cannot exceed the rated voltage of the display panel.

S17: Output step: output the compensation voltage of each display area to each display area to compensate a current value I of each display area such that each display area could evenly generate light.

In addition, output step comprises:

S171: Detection step: detect the current value of each display area and store the current value of each display area into a database. Here, this step could be similar to the step S122. That is, the scan TFT 11 is turned off and the sensing TFT 13 is turned on. The current flows through the driving TFT 12 and the sensing TFT 13 from VDD and charges the wire parasitic capacitor or the capacitor of the analog-to-digital converter (ADC). After a specific period of time, the ADC could provide the current value by converting the voltage level of the sensing line.

S172: Third calculating step: collect the current value and the threshold value of the predetermined TFT of each display area, calculate a relationship between constants k of different display areas (such as the ratio of the constants k of different areas) according to a current formula, and store the relationship into the database. Here, the current formula and the constant k had been discussed in the background session and thus omitted here.

S173: Second adjusting step: collect the relationship and the current value of each display area, and adjust the threshold value of the TFT of each display area according to the current formula to make the current of each display area consistent.

The present invention provides a voltage adjusting method for a display panel. The method could utilize the ratio of Vgs of two different tests, as an adjustment factor, to compensate the voltage value of each display area. Thus, the method could obtain the same compensation voltage for different display area to compensate the voltage difference between the node G and the node S. This could reduce the influence of the output step. In addition, the method could further detect the inputted compensation voltage to obtain a current value according to a second adjusting step. Through the current formula, the ratio of constant k of each display area could be obtained to adjust the threshold value of the TFT according to the current formula such that the current of each display area could be consistent.

In addition, the present invention further provides a computer readable medium. The computer readable medium stores computer programs for a processor to execute to perform the above-mentioned voltage adjusting method.

Furthermore, the present invention further provides an electronic equipment. The electronic equipment comprises a memory, a database, a processor, a timing controller, a gate driver and a data driver.

The memory is used to store executable program codes. The database is used to store the display data of each display area of the display panel. The processor reads the executable program codes to execute the corresponding programs of the program codes to perform the above-mentioned voltage adjusting method.

The compensation voltage obtained from the first adjusting step is converted into the pixel voltage by the ADC. The pixel voltage is then used to drive the corresponding sub-pixel. Finally, the compensation current is obtained from the second adjusting step and is used to work with the gate driver to drive the display panel to generate light. The database could be embedded in the timing controller or independent from the timing controller.

The voltage adjusting method for a display panel could utilize the ratio of Vgs of two different tests, as an adjustment factor, to compensate the voltage value of each display area. Thus, the method could obtain the same compensation voltage for different display area to compensate the voltage difference between the node G and the node S. This could reduce the influence of the output step. In addition, the method could further detect the inputted compensation voltage to obtain a current value according to a second adjusting step. Through the current formula, the ratio of constant k of each display area could be obtained to adjust the threshold value of the TFT according to the current formula such that the current of each display area could be consistent.

Above are embodiments of the present invention, which does not limit the scope of the present invention. Any modifications, equivalent replacements or improvements within the spirit and principles of the embodiment described above should be covered by the protected scope of the invention.

What is claimed is:

1. A voltage adjusting method for a display panel comprising:

a database establishing step, loading display data of a display panel, wherein the display data includes a voltage value and an adjustment factor of each display area and the voltage value of each display area is consistent;

a first collecting step, collecting the voltage value and the adjustment factor of each display area;

a first calculating step, predetermining a compensation factor for each display area and multiplying the voltage value, the adjustment factor and the compensation factor to obtain a compensation voltage; and a first adjusting step, adjusting the compensation factor for each display area to make the compensation voltage of each display area consistent such that each display area evenly generates light;

wherein the display data further comprises a threshold value of a predetermined thin film transistor (TFT) of each display area, and wherein the adjustment factor relates to voltage across the gate and source of the predetermined TFT.

2. The voltage adjusting method of claim 1, further comprising:

an output step, outputting the compensation voltage of each display area to each display area to compensate a current value of each display area.

3. The voltage adjusting method of claim 2, wherein the step of compensating the current value of each display area comprises:

a detection step, detecting the current value of each display area and store the current value of each display area into a database;

a third calculating step, collecting the current value and the threshold value of the predetermined TFT of each display area, calculating a relationship between constants k of different display areas according to a current formula, and storing the relationship into the database; and a second adjusting step, collecting the relationship and the current value of each display area, and adjusting the threshold value of the TFT of each display area according to the current formula to make the current of each display area consistent.

4. The voltage adjusting method of claim 3, wherein the testing step comprises:

a pre-sensing step, turning on a first switch and a second switch to collect a voltage difference Vgs between a node G and a node S, wherein Vgs=Vdata−Vref, Vdata represents a voltage level of the node G and Vref represents a voltage level of the node S;

a sampling step, turning off a scan TFT and turning on a sensing TFT to collect a current voltage difference Vgs' between the node G and the node S; and a second calculating step, calculating a ratio of Vgs' and Vgs to obtain the adjustment factor of each display area.

5. The voltage adjusting method of claim 2, further comprising a testing step, wherein the testing step comprises:

obtaining the current value of each display area through voltages converted by an analog-to-digital converter.

6. The voltage adjusting method of claim 1, further comprising:

a preparation step, providing the display panel, dividing the display panel into a plurality of display areas, and inputting the voltage value to each of the display panel; and a testing step, obtaining the adjustment factor of each display are through a penal luminance measurement method;

wherein the preparation step and the testing step are prior to the data base establishing step.

7. The voltage adjusting method of claim 1, wherein the display area comprises one sub-pixel or multiple sub-pixels.

8. The voltage adjusting method of claim 1, wherein the display panel comprises an OLED display panel, a micro LED display panel or a Mini LED display panel.

9. A non-transitory computer readable medium, storing computer programs for a processor to execute to perform operations of:

a database establishing operation, loading display data of a display panel, wherein the display data includes a voltage value and an adjustment factor of each display area and the voltage value of each display area is consistent;

a first collecting operation, collecting the voltage value and the adjustment factor of each display area;

a first calculating operation, predetermining a compensation factor for each display area and multiplying the voltage value, the adjustment factor and the compensation factor to obtain a compensation voltage; and a first adjusting operation, adjusting the compensation factor for each display area to make the compensation voltage of each display area consistent such that each display area evenly generates light;

wherein the display data further comprises a threshold value of a predetermined thin film transistor (TFT) of each display area, and wherein the adjustment factor relates to voltage across the gate and source of the predetermined TFT.

10. The non-transitory computer readable medium of claim 9, wherein the operations further comprise:

an output operation, outputting the compensation voltage of each display area to each display area to compensate a current value of each display area.

11. The non-transitory computer readable medium of claim 10, wherein the operation of compensating the current value of each display area comprises:

a detection operation, detecting the current value of each display area and store the current value of each display area into a database;

a third calculating operation, collecting the current value and the threshold value of the predetermined TFT of each display area, calculating a relationship between constants k of different display areas according to a current formula, and storing the relationship into the database; and a second adjusting operation, collecting the relationship and the current value of each display area, and adjusting the threshold value of the TFT of each display area according to the current formula to make the current of each display area consistent.

12. The non-transitory computer readable medium of claim 11, wherein the testing operation comprises:

a pre-sensing operation, turning on a first switch and a second switch to collect a voltage difference Vgs between a node G and a node S, wherein Vgs=Vdata−Vref, Vdata represents a voltage level of the node G and Vref represents a voltage level of the node S;

a sampling operation, turning off a scan TFT and turning on a sensing TFT to collect a current voltage difference Vgs' between the node G and the node S; and a second calculating operation, calculating a ratio of Vgs' and Vgs to obtain the adjustment factor of each display area.

13. The non-transitory computer readable medium of claim 10, further comprising a testing operation, wherein the testing operation comprises:

obtaining the current value of each display area through voltages converted by an analog-to-digital converter.

14. The non-transitory computer readable medium of claim 9, wherein before the database establishing operation, the operations further comprise:

a preparation operation, providing the display panel, dividing the display panel into a plurality of display areas, and inputting the voltage value to each of the display panel; and a testing operation, obtaining the adjustment factor of each display are through a penal luminance measurement method;

wherein the preparation operation and the testing operation are prior to the data base establishing operation.

15. The non-transitory computer readable medium of claim 9, wherein the display area comprises one sub-pixel or multiple sub-pixels.

16. The non-transitory computer readable medium of claim 9, wherein the display panel comprises an OLED display panel, a micro LED display panel or a Mini LED display panel.

* * * * *